US007894744B2

(12) United States Patent
Sato et al.

(10) Patent No.: US 7,894,744 B2
(45) Date of Patent: Feb. 22, 2011

(54) COLOR IMAGE FORMING APPARATUS, AND TONER REPLENISHING APPARATUS

(75) Inventors: Masumi Sato, Kanagawa (JP); Tomotoshi Nakahara, Kanagawa (JP); Hiroyasu Shijo, Kanagawa (JP); Motokazu Yasui, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/136,467

(22) Filed: Jun. 10, 2008

(65) Prior Publication Data

US 2008/0247795 A1 Oct. 9, 2008

Related U.S. Application Data

(62) Division of application No. 11/338,805, filed on Jan. 25, 2006, now Pat. No. 7,436,417, which is a division of application No. 10/921,257, filed on Aug. 19, 2004, which is a division of application No. 09/903,787, filed on Jul. 13, 2001.

(30) Foreign Application Priority Data

Jul. 14, 2000 (JP) ..... 2000-215004
May 9, 2001 (JP) ..... 2001-138526

(51) Int. Cl.
*G03G 15/00* (2006.01)
*G03G 15/01* (2006.01)

(52) U.S. Cl. ..... 399/107; 399/299; 399/405

(58) Field of Classification Search ..... 399/107, 399/299, 300, 303, 405, 329, 401, 400
See application file for complete search history.

(56) References Cited

U.S. PATENT DOCUMENTS 5,005,517 A 4/1991 Fukui et al.
5,146,270 A 9/1992 Matsuo et al.
5,160,946 A 11/1992 Hwang
5,249,025 A 9/1993 Nakazawa et al.
5,257,037 A 10/1993 Haneda et al.
5,272,510 A 12/1993 Reese et al.

(Continued)

FOREIGN PATENT DOCUMENTS

CN 1202641 A 12/1998

(Continued)

OTHER PUBLICATIONS

Patent Abstracts of Japan, JP 11-095519; Apr. 9, 1999.

(Continued)

*Primary Examiner*—Sandra L Brase
(74) *Attorney, Agent, or Firm*—Oblon, Spivak, McClelland, Maier & Neustadt, L.L.P.

(57) ABSTRACT

The color image forming apparatus comprises a transfer belt device which feeds a transfer member such as a paper and a plurality of image forming units. The image forming units are disposed facing toward the transfer belt device. The transfer belt device, at least in a portion in which the image forming units have been disposed, is arranged such that it is inclined with respect to the ground. Each of the image forming unit forms a desired image and sequentially transfers the formed image on the transfer member fed by the transfer belt device.

9 Claims, 4 Drawing Sheets

U.S. PATENT DOCUMENTS

| | | | | |
|---|---|---|---|---|
| 5,376,999 | A | 12/1994 | Hwang | |
| 5,602,633 | A | 2/1997 | Yoshida et al. | |
| 5,612,771 | A | 3/1997 | Yamamoto et al. | |
| 5,627,579 | A | 5/1997 | Fisli | |
| 5,724,633 | A | 3/1998 | Amemiya | |
| 5,765,082 | A | 6/1998 | Numazu et al. | |
| 5,778,294 | A * | 7/1998 | Hiraoka et al. | 399/329 |
| 5,784,675 | A | 7/1998 | Inoue et al. | |
| 5,794,105 | A | 8/1998 | Tamaoki et al. | |
| 5,828,925 | A | 10/1998 | Yoshizawa | |
| 5,854,958 | A | 12/1998 | Tanimoto et al. | |
| 5,887,228 | A | 3/1999 | Motohashi et al. | |
| 5,923,356 | A | 7/1999 | Gibson et al. | |
| 5,950,055 | A | 9/1999 | Yahata et al. | |
| 5,963,754 | A * | 10/1999 | Itoh et al. | |
| 5,966,569 | A | 10/1999 | Haneda | |
| 5,995,717 | A | 11/1999 | Tanaka | |
| 6,002,897 | A | 12/1999 | Kohno et al. | |
| 6,035,158 | A | 3/2000 | Asakura et al. | |
| 6,055,390 | A * | 4/2000 | Kurotaka et al. | 399/329 X |
| 6,100,912 | A | 8/2000 | Shiraishi et al. | |
| 6,154,628 | A | 11/2000 | Kawano | |
| 6,157,794 | A | 12/2000 | Katsumi et al. | |
| 6,185,381 | B1 * | 2/2001 | Nakahara et al. | 399/401 X |
| 6,243,559 | B1 * | 6/2001 | Kurotaka et al. | 399/329 |
| 6,259,874 | B1 | 7/2001 | Murakami et al. | |
| 6,259,877 | B1 | 7/2001 | Taniyama et al. | |
| 6,324,370 | B1 | 11/2001 | Isobe et al. | |
| 6,331,004 | B1 * | 12/2001 | Katou et al. | 399/401 X |
| 6,356,732 | B1 * | 3/2002 | Watanabe et al. | 399/299 |
| 7,212,764 | B2 | 5/2007 | Sato et al | |
| 2003/0198491 | A1 | 10/2003 | Sato | |
| 2007/0177902 | A1 | 8/2007 | Sato et al. | |

FOREIGN PATENT DOCUMENTS

| | | |
|---|---|---|
| JP | 61-167655 | 10/1986 |
| JP | 62-264144 | 11/1987 |
| JP | 63-170663 | 7/1988 |
| JP | 4-122951 | 4/1992 |
| JP | 4-131873 | 5/1992 |
| JP | 5-241457 | 9/1993 |
| JP | 5-341587 | 12/1993 |
| JP | 6-46191 | 2/1994 |
| JP | 6-194889 | 7/1994 |
| JP | 7-210063 | 8/1995 |
| JP | 7-287495 | 10/1995 |
| JP | 8-87151 | 4/1996 |
| JP | 9-015933 | 1/1997 |
| JP | 9-114172 | 5/1997 |
| JP | 9-269626 | 10/1997 |
| JP | 9-292797 | 11/1997 |
| JP | 9-325560 | 12/1997 |
| JP | 10-20608 | 1/1998 |
| JP | 10-39566 | 2/1998 |
| JP | 10-48898 | 2/1998 |
| JP | 10-149056 | 6/1998 |
| JP | 10-186254 | 7/1998 |
| JP | 10-207171 | 8/1998 |
| JP | 10-207223 | 8/1998 |
| JP | 10-213941 | 8/1998 |
| JP | 10-239938 | 9/1998 |
| JP | 10-253906 | 9/1998 |
| JP | 10-333395 | 12/1998 |
| JP | 11-015347 | 1/1999 |
| JP | 11-84792 | 3/1999 |
| JP | 11-95519 | 4/1999 |
| JP | 11-95520 | 4/1999 |
| JP | 11-143167 | 5/1999 |
| JP | 11/143328 | 5/1999 |
| JP | 11-184202 | 7/1999 |
| JP | 11-254748 | 9/1999 |
| JP | 11-327414 | 11/1999 |
| JP | 11-338216 | 12/1999 |
| JP | 2000-47465 | 2/2000 |
| JP | 2000-66471 | 3/2000 |
| JP | 2000-66472 | 3/2000 |
| JP | 2000-98713 | 4/2000 |
| JP | 2000-118787 | 4/2000 |
| JP | 2000-137364 | 5/2000 |
| JP | 2000-147879 | 5/2000 |
| JP | 2000-235290 | 8/2000 |
| JP | 2001-117304 | 4/2001 |
| JP | 2001-121783 | 5/2001 |

OTHER PUBLICATIONS

Patent Abstracts of Japan, JP 9-114172; May 2, 1997.
Patent Abstracts of Japan; JP 62-264144, Nov. 17, 1987.
Patent Abstracts of Japan, JP 11-015347; Jan. 22, 1999.
Patent Abstracts of Japan, JP 9-015933; Jan. 17, 1997.

* cited by examiner

COLOR IMAGE FORMING APPARATUS, AND TONER REPLENISHING APPARATUS

CROSS-REFERENCE TO RELATED APPLICATIONS

This application is a divisional Application of, and claims the benefit of priority under 35 U.S.C. §120 from, U.S. application Ser. No. 11/338,805, filed Jan. 25, 2006, the entire contents of which is incorporated herein by reference. U.S. application Ser. No. 11/338,805 is a divisional Application of, and claims priority to U.S. application Ser. No. 10/921,257, filed Aug. 19, 2004, now U.S. Pat. No. 7,212,764, which is also a divisional Application of and claims priority to U.S. application Ser. No. 09/903,787, filed Jul. 13, 2001, now U.S. Pat. No. 6,973,283. This application claims priority to Japanese Application No. 2000-215004 filed on Jul. 14, 2000 and Japanese Application No. 2001-138526 filed on May 9, 2001.

BACKGROUND OF THE INVENTION

1. Field of the Invention

The present invention relates to a color image forming apparatus and a toner replenishing apparatus for use in the color image forming apparatus.

2. Description of the Related Art

Color image forming systems for color image forming apparatuses are roughly classified into four types of transfer drum system, intermediate transfer system, image-on-image system and tandem system.

The transfer drum system is a system in which a transfer sheet wound around a transfer drum composed of a dielectric film is disposed opposite to a photosensitive member, and toners of yellow (Y), magenta (M), cyan (C) and black (Bk) are superimposed on the transfer sheet in sequence by repeating an electrophotographic process consisting of formation, development and transferring of an electrostatic latent image with respect to each of the colors, thereby obtaining a full color image.

The intermediate transfer system is a system in which a full color image is formed by transferring toner images of colors in sequence onto a drum or a belt called an intermediate transfer member in place of the transfer sheet used in the transfer drum system, and then, the full color image is transferred again onto a transfer sheet by one operation.

The image-on-image system is a system in which an image is transferred onto a transfer sheet by repeating an electrophotographic process consisting of formation, development and transferring of an electrostatic latent image with respect to each of yellow (Y), magenta (M), cyan (C) and black (Bk) directly on a photosensitive member.

The tandem system is a system in which a full color image is obtained on a transfer sheet by transferring images formed by image forming units in sequence onto a single piece of transfer sheet fed by a transfer belt.

The color image forming apparatuses using the above-described systems have merits and demerits, respectively. Among them, the color image forming apparatus of the tandem system has excellent characteristics. Because, for example, it can use a large variety of transfer sheets, obtain a full color image of a high quality, and obtain a full color image at a high speed. In particular, the characteristic that a full color image can be obtained at a high speed is not provided for the color image forming apparatuses of the other systems, and therefore, is peculiar to the color image forming apparatus of the tandem system.

In the image forming apparatus of the tandem system, four image forming units must be arranged along the direction of movement of the transfer belt. In most image forming apparatuses of the tandem system, the upper traveling side of the transfer belt generally extends in a horizontal direction, and the four image forming units are arranged on the transfer belt. However, each of the image forming units is provided with a photosensitive member having means for charging, developing, cleaning and the like therearound. If the above-described image forming units are juxtaposed on the transfer belt, the image forming apparatus becomes great in width, thereby requiring a large installation space.

In view of this, Japanese Patent Application Laid-open No. 10-239938 discloses an image forming apparatus in which a transfer belt is erected vertically. Since image forming units are arranged vertically along the transfer belt, it is possible to provide an image forming apparatus which can be reduced in width and can be installed in a small space.

However, it is inevitable that the height of a casing becomes greater in the image forming apparatus in which the transfer belt is vertically erected. Therefore, in an image forming apparatus in which the upper surface of the casing is used as a sheet discharging tray, as implemented in many recent printers, there has arisen a problem of poor workability because the position of the sheet discharging tray is too high.

SUMMARY OF THE INVENTION

It is an object of the present invention to provide a compact color image forming apparatus in which poor workability can be suppressed even if the upper surface of a casing is used as a sheet discharging tray, and a toner replenishing apparatus for use in the color image forming apparatus.

The color image forming apparatus according to the present invention comprises a transfer belt device which feeds a transfer member such as a paper and a plurality of image forming units. The image forming units are disposed facing towards the transfer belt device. The transfer belt device, at least in a portion in which the image forming units have been disposed, is arranged such that it is inclined with respect to the ground. Each of the image forming unit forms a desired image and sequentially transfers the formed image on the transfer member fed by the transfer belt device.

Other objects and features of this invention will become apparent from the following description with reference to the accompanying drawings.

DETAILED DESCRIPTION OF THE PREFERRED EMBODIMENTS

Embodiments of the color image forming apparatus and the toner replenishing apparatus of this invention will be described below in reference to the accompanying drawings.

Figure 1:
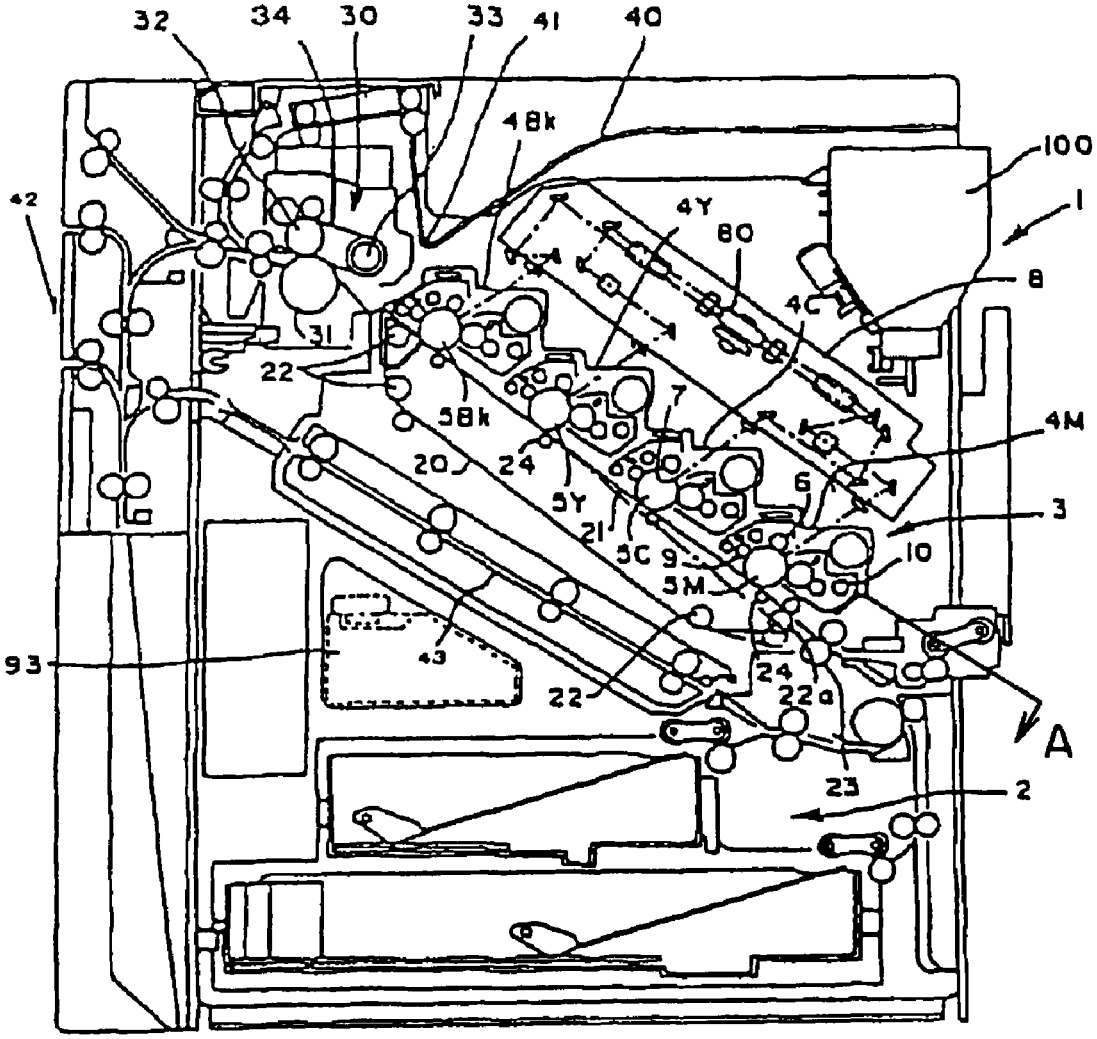
FIG. 1 is a schematic view showing the entire configuration of a color image forming apparatus according to the present invention.

FIG. 1 is a schematic view showing a color laser printer which is one example of a color image forming apparatus according to the present invention. The color laser printer 1 is configured such that a sheet supplying section 2 is provided in the lower portion of the body of the device ("apparatus body") and an image forming section 3 is disposed above the sheet supplying section 2. In the image forming section 3, a transfer belt device is slantwise disposed in such a manner as to set a sheet supplying side at the lower portion thereof and a sheet discharging side at the upper portion thereof. The transfer belt device 20 includes an endless transfer belt 20 wound around a plurality of, e.g., four belt wheels 22 in the present embodiment. At an upper traveling side 21 of the transfer belt 20 are juxtaposed four image forming units 4M, 4C, 4Y and 4Bk for magenta (M), cyan (C), yellow (Y) and black (Bk) in order from below.

Figure 2:
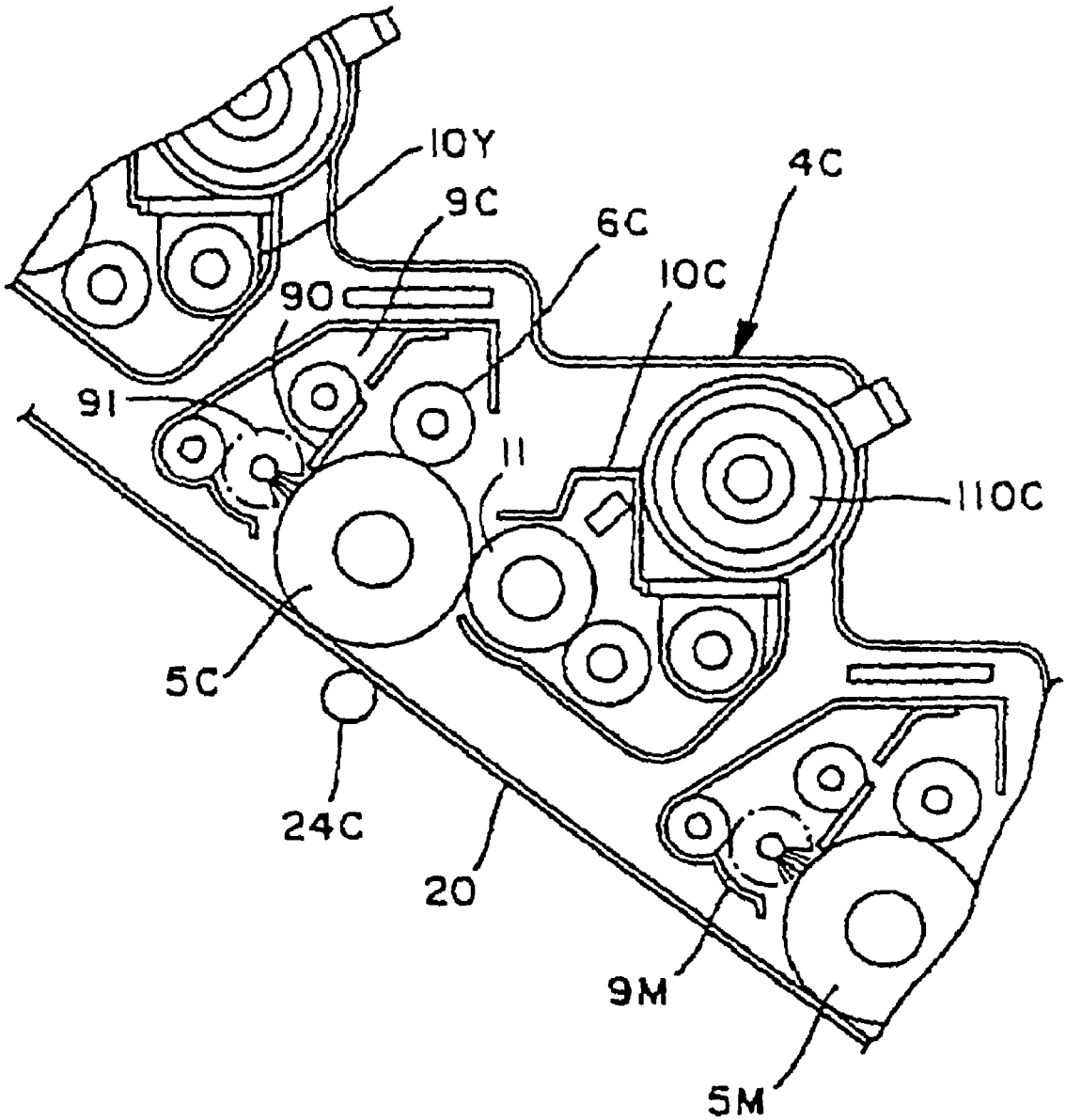
FIG. 2 is an enlarged view illustrating one of image forming units in the color image forming apparatus shown in FIG. 1.

FIG. 2 is an enlarged view illustrating the image forming unit 4C. Same reference numerals have been provided to the components that perform same or similar functions as those in FIG. 1, however, a suffix M, C or Y is provided to distinguish the units related to the colors magenta, cyan, or yellow respectively.

In FIG. 1 and FIG. 2, each of the image forming units 4M, 4C, 4Y and 4Bk is provided with a photosensitive drum 5 serving as an image carrier. The photosensitive drum 5 is driven to be rotated clockwise by a not shown driving unit. Around the photosensitive drum 5 are provided a charging roll 6 serving as a charging unit, an optical writer 7 for performing writing with a laser beam by an optical writing device 8, a developing device 10 serving as developing unit and a cleaning device 9 serving as cleaning unit. The developing device 10 is a two-component developing device composed of a toner and a carrier, and is replenished with a toner by a toner replenishing apparatus, described later, according to a consumption of the toner.

The image forming operation for full color printing performed by the color printer shown in FIG. 1 by way of the image forming unit 4M for magenta will now be explained.

An optical image to be developed with a magenta toner is optically written in a photosensitive drum 5M charged by a charging roll 6M by the writing unit 8, which irradiates a polygon mirror 80 with a laser beam by driving an LED (a laser diode), not shown, and introduces a reflected beam onto the photosensitive drum 5M via a cylinder lens or the like. By this optical writing, an electrostatic latent image in accordance with image data transmitted from a host machine such as a personal computer is formed on the photosensitive drum 5M. The latent image is turned into a visible image with the magenta toner by the developing device 10. Incidentally, the writing unit 8 is configured in such a manner as to perform writing in each of the photosensitive drums 5 with the reflected beam from the single polygon mirror 80. In this case, the writing unit 8 is slantwise disposed substantially in parallel to the transfer belt 20, thereby easily making the length of an optical path up to each of the photosensitive members uniform.

In the meantime, a sheet designated as a transfer member is supplied from the sheet supplying section 2. The supplied sheet once abuts against a registration roller 23 disposed upstream in a direction in which the transfer belt 20 is transported. Thereafter, the sheet is fed onto the transfer belt 20 in synchronism with the visible image, and then, reaches a transfer position facing the photosensitive drum 5M as the belt travels. At this transfer position, the visible image of the magenta toner is transferred onto the sheet by the effect of a transfer roll 24 disposed at the back surface of the transfer belt 20.

In the same manner as the above-described image forming operation, a visible image is formed on the photosensitive drum 5 with a toner of each color in each of the other image forming units 4C, 4Y and 4Bk. These visible images are transferred in superimposition every time the sheet fed by the transfer belt 21 reaches each of the transfer positions. Consequently, in the color printer in the present embodiment, a full color image can be transferred onto the sheet in superimposition in as almost short a time as that in a monochromatic case.

The sheet after the transferring is separated from the transfer belt 20, and then, is fixed by a fixing device 30. The fixing device in the present embodiment is of a belt fixing type, in which a relatively soft fixing roller 32, e.g., a sponge roller is brought into press-contact with a hard pressurizing roller 31. A belt 34 is wound around the fixing roller 32 and a heating roller 33 disposed upstream in the sheet feeding direction. This belt fixing system has the advantage of, for example, a short warming-up time in comparison with a roller fixing system.

Operation is selectively switched such that the sheet after the fixation is discharged outside of the apparatus as it is or that the sheet after the fixation is fed to a reversing unit 42 for double-sided printing. If the operation is selected such that the sheet is discharged outside of the apparatus, the sheet is reversed upward, and then, is discharged to a sheet discharging tray 40 disposed at the upper surface of the apparatus body with the reverse thereof oriented upward. It is almost an essential condition for the printer that the sheet is discharged with the reverse thereof oriented upward so as to stack printouts in order of page. In contrast, if the double-sided printing is selected, the sheet is fed to the reversing unit 42, in which the sheet is reversed from obverse to reverse, and then, is fed to a double-sided transporting path 43. The double-sided transporting path 43 is slantwise disposed under and substantially in parallel to the transfer belt 20. If the double-sided transporting path 43 is slantwise disposed in the above-described manner, a transporting distance can be shortened or the sheet can be drawn out together with the transfer belt 20 in case of generation of jamming. An image is formed on the reverse of the transfer sheet passing the double-sided transporting path in the same manner as described above, and thereafter, the sheet is discharged to the sheet discharging tray 40.

As is obvious from the above description, the double-sided transporting path 43 is slantwise disposed substantially in parallel to the transfer belt 20 in the present embodiment, so that the transfer member after the fixation can be returned toward the registration roller 23 at a shortest distance. For example, if the double-sided transporting path 43 is disposed horizontally, the path passes near the upper surface of an upper cassette. In this case, the transfer member must be descended down to the height level of the transporting path, thereby elongating the path.

The color printer such configured as described above is provided with the four image forming units 4M, 4C, 4Y and 4Bk, and the respective toner images of the colors are sequentially transferred in superimposition onto the sheet while the sheet is fed by the transfer belt device 20. Consequently, it is possible to remarkably shorten an image forming time in comparison with the intermediate transfer system in which only one image forming unit transfers toner images onto an intermediate transfer member in superimposition, and then, transfers the transferred toner-images onto a sheet by one operation. At this time, although the color printer according to the present invention is provided with the four image forming units 4M, 4C, 4Y and 4Bk, the traveling side 21 of the transfer belt 20 at which the image forming units are arranged is slantwise inclined as described above, so that the adjacent image forming units 4 are arranged in such a manner that the cleaning device 9 in one of the adjacent image forming units vertically overlaps with the developing device 10 in the other image forming unit, as shown in FIG. 2. Specifically, the adjacent image forming units 4M and 4C are arranged in such a manner that a cleaning device 9M in the image forming unit 4M vertically overlaps with a developing device 10C in the image forming unit 4C. Consequently, it is possible to shorten the lateral length in comparison with an apparatus in which a transfer belt is horizontally disposed.

Figure 3:
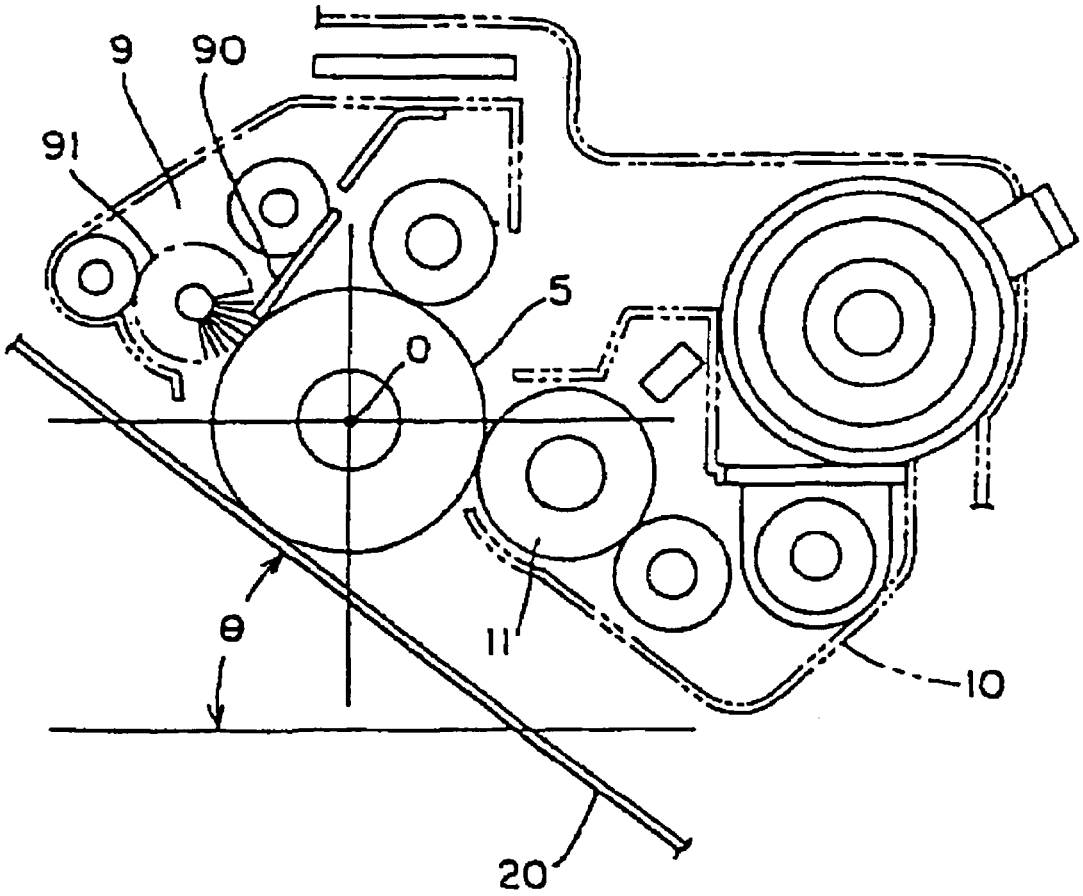
FIG. 3 is a view illustrating the relationship of arrangement in the color image forming apparatus shown in FIG. 1.

As shown in FIG. 3, assume that the inclination angle of the transfer belt 20 is designated by θ. If the angle θ is small, the developing device 10 and the cleaning device 9 in the adjacent image forming units cannot be disposed in such a manner as to overlap with each other, unlike the above description. In contrast, if the angle θ is about 90°, the lateral length can be remarkably shortened while a vertical height to some extent is needed, thereby making the position of the sheet discharging tray too high. Therefore, it is preferable that the inclination angle θ of the transfer belt 20 should range from 35° to 55°. As shown in FIG. 3, if the inclination angle θ is set between 35° and 55°, a developing position of the developing device 10, i.e., a position at which a magnetic brush formed in a developing roller 11 is brought into contact with the photosensitive drum 5 can be located in a lower right quadrant when the transfer belt 20 is brought into contact with the photosensitive drum 5 in a lower left quadrant, the center O of rotation of the photosensitive drum 5 being regarded as an origin.

In this manner, the developing device 10, which is disposed in such a manner as to develop in the lower right quadrant of the photosensitive drum 5, has the advantage of alleviation of coming-off of the toner in comparison with a developing device which is disposed at the same height level as or above the center of rotation of the photosensitive drum 5. Furthermore, when the inclination angle θ of the transfer belt 20 is set between 35° and 55° and the transfer belt 20 is brought into contact with the photosensitive drum 5 in the lower left quadrant, the center O of rotation being regarded as the origin, a cleaning blade 90 and a fur brush 91 of the cleaning device 9 can be brought into contact with the photosensitive drum 5 in an upper left quadrant of the photosensitive drum 5.

The cleaning device 9 disposed in the above-described manner is more excellent in cleaning property than a cleaning device in which cleaning members such as a cleaning blade are brought into contact with a photosensitive drum 5 substantially right above the photosensitive drum 5.

As shown in FIG. 1, in the color printer in which the transfer belt 20 is inclined and the image forming units 4M, 4C, 4Y and 4Bk are arranged along the inclination, the transfer belt 20 is disposed substantially on the diagonal of the printer body. In this layout, the traveling side 21 of the transfer belt 20 is driven to be moved from below to above, and the sheet feeding section and the sheet discharging section are disposed in the lower portion and the upper portion of the main body, respectively, so that both of the transporting path from the sheet feeding section to the transfer belt 20 and the transporting path from the transfer belt 20 to the sheet discharging section can be shortened remarkably advantageously.

Moreover, the casing of the image forming apparatus such as the printer is formed into a substantially rectangular parallelepiped. In the printer of this type, if the transfer belt 20 is slantwise disposed, spaces, each having a substantially triangular shape in cross section, are defined above and under the transfer belt 20. In the present embodiment, a toner containing vessel 100 is housed in the upper space, and further, a waste toner tank 93 is housed in the lower space. In this case, since the toner containing vessel 100 or the waste toner tank 93 has a remarkably greater freedom of a shape, it may be formed into a shape in conformity with the defined triangular space or it may be disposed opposite to the transfer belt 20 with a surface inclined in the same direction as the inclination of the transfer belt 20. Consequently, it is possible to securely eliminate a fear that the space having the triangular shape in cross section becomes a dead space.

Subsequently, a toner replenishing apparatus for replenishing the toner contained in the toner containing vessel 100 to each of the image forming units 4M, 4C, 4Y and 4Bk will now be explained.

Figure 4:
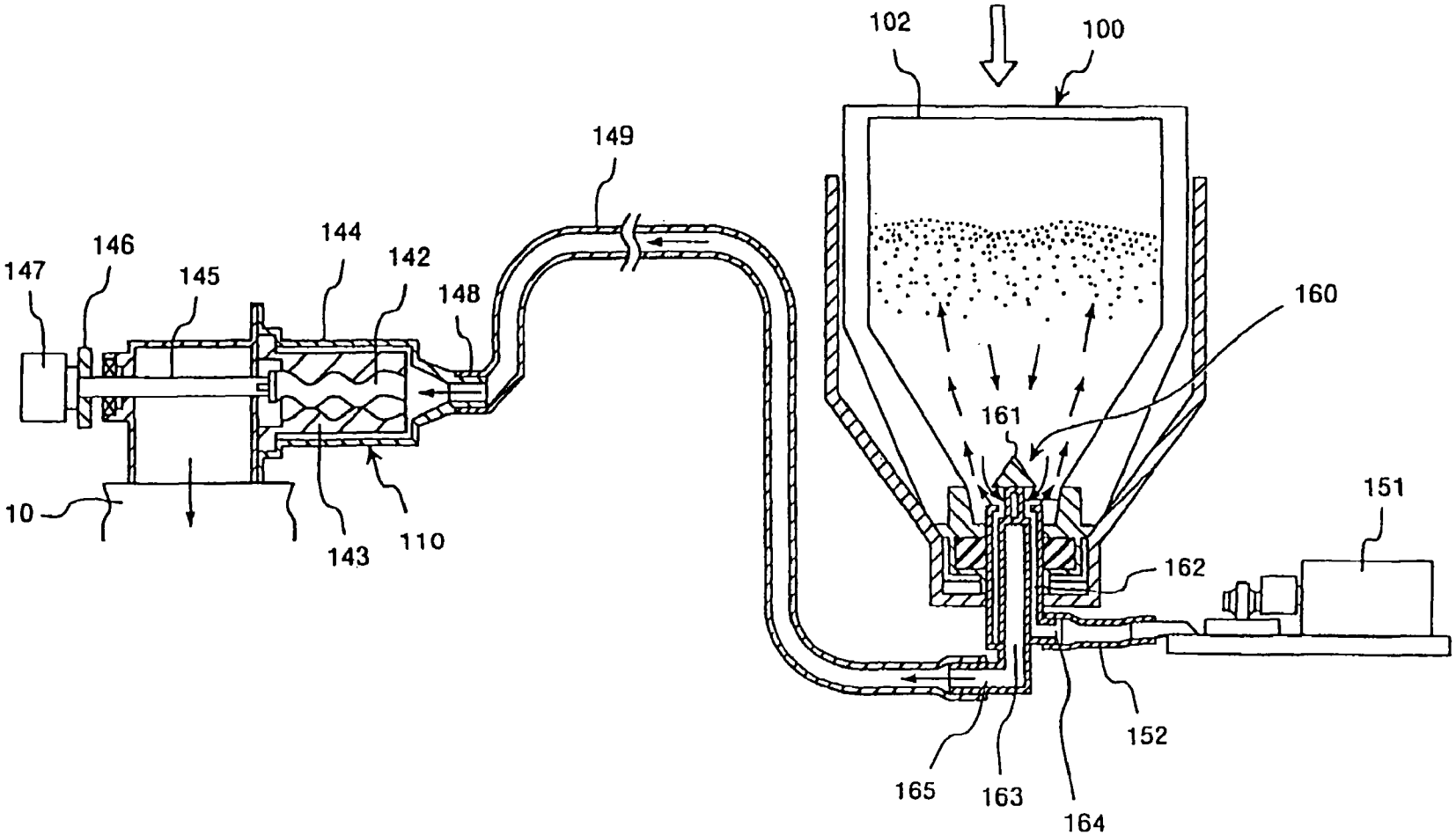
FIG. 4 is a cross-sectional view showing a toner replenishing apparatus in a preferred embodiment according to the present invention.

A powder pump 110, i.e., a uniaxial eccentric screw pump of a suction type is disposed in the vicinity of or integrally with the developing device 10. The powder pump 110 comprises a rotor 142 made of a material having rigidity such as metal and formed into a shape of an eccentric screw, a stator 143 made of an elastic material such as rubber and formed into a shape of a two-thread screw, and a holder 144 enveloping the rotor 142 and the stator 143, being made of a resin material and forming a powder transporting path, as shown in FIG. 4. The rotor 142 is driven to be rotated via a gear 146 integrally connected to a drive shaft 145 joined via a pin joint. Incidentally, reference numeral 147 designates an electromagnetic clutch, which controls the operation of the powder pump 110.

Additionally, a toner sucking portion 148 is disposed at the tip of the holder 144, i.e., at the right end thereof in FIG. 4, and is connected to a toner connecting port 165 formed at a nozzle 160, later described, via a toner conveying tube 149. It is remarkably effective to use a flexible tube having a diameter of, e.g., 4 mm to 10 mm and being made of a rubber material excellent in toner resistance (for example, polyurethane, nitrile, EPDM, silicon or the like) as the toner conveying tube 149. Such a flexible tube can be easily installed vertically or laterally in an arbitrary direction.

In this toner replenishing apparatus, it has been known that the uniaxial eccentric screw pump serving as the powder pump 110 can continuously convey a constant quantity of toner in a high fixed air ratio, and further, that it can precisely convey a quantity of toner in proportion to the rotational speed of the rotor 142. Therefore, when a toner replenishing command is issued upon detection of an image concentration or the like, the powder pump 110 is actuated to replenish a required quantity of toner to the developing device 10.

In the meantime, a setting section in the image forming apparatus body, in which the toner containing vessel 100 is set, is configured as a unit independent of the developing device 10. In the setting section is erected the nozzle 160 which has a circular shape in cross section and is inserted into a toner bag 102. The toner containing vessel 100 is installed from above in the setting section in the image forming apparatus body. A projecting member 161 formed into a drill-like shape in cross section is molded integrally with or fixed to the upper portion of the nozzle 160 disposed in the setting section. An air supplying path 162 and a toner supplying path 163 are provided continuously from the projecting member 161. The inside of the nozzle 160 is formed into a double-pipe structure. The toner supplying path 163 is bent leftward in FIG. 4 at the lower end of the nozzle 160, and further, the toner connecting port 65 connected to the toner conveying tube 149 is disposed at the tip of the toner supplying path 163. Moreover, the air supplying path 162 is bent rightward in FIG. 4 above the toner supplying path 163, and reaches an air connecting port 164.

The air connecting port 164 is connected to an air pump 151 serving as air supplying unit via an air conveying pipe 152 in the present embodiment. When the air pump 151 is actuated, air is jetted into the toner containing vessel 100 from the air pump 151 via the air conveying pipe 152 and the air supplying path 162. Thus, the air jetted inside the toner containing vessel 100 passes toner layers to allow the toner to be diffused and fluidized.

The toner replenishing apparatus such configured as described above can securely replenish the toner even if each of the image forming units 4M, 4C, 4Y and 4Bk is separated from the toner containing vessel 100. The toner containing vessel 100 can be installed at an arbitrary position irrespective of the image forming units 4M, 4C, 4Y and 4Bk. Consequently, in the color printer in which the transfer belt 20 is inclined and each of the image forming units 4M, 4C, 4Y and 4Bk is disposed along the inclination, it is unnecessary to define spaces for toner containers among the image forming units 4M, 4C, 4Y and 4Bk, and therefore, the image forming units 4M, 4C, 4Y and 4Bk can be arranged close to each other.

Additionally, although the belt fixing device 30 is used in the preferred embodiment shown in FIG. 1, the sheet is fed slantwise from below along the inclined transfer belt 20, so that the heating roller 33 can be disposed lower than the height level of the fixing roller 32. As a result, the sheet off a nip can be fed substantially in a horizontal direction while sufficiently securing a nip width between the fixing roller 32 and the pressurizing roller 31, so that the sheet can be smoothly fed to the sheet discharging tray 40 disposed at the upper portion of the apparatus body. Incidentally, if the sheet is fed into the nip between the fixing roller 32 and the pressurizing roller 31 in the horizontal direction, the sheet is fed slantwise downward when it passes. Therefore, a mechanism for reversing the sheet at a great angle is required in order to feed the sheet to the sheet discharging tray 40 disposed at the upper portion of the apparatus body.

The fixing device 30 my be disposed above the inclined transfer belt 20 and higher than the height level of the optical writing device 8 in the preferred embodiment shown in FIG. 1. Consequently, it is seldom that the optical writing device 8 directly undergoes heat generated in the fixing device 30. Moreover, a substantially V-shaped recess 41 for securing the number of sheets stocked on the sheet discharging tray 40 is defined between the fixing device 30 and the optical writing device 8. With the recess 41, a space outside of the apparatus is defined between the fixing device 30 and the optical writing device 8. With this configuration, it is more seldom that the optical writing device 8 directly undergoes the heat generated in the fixing device 30, thereby remarkably reducing fluctuations in characteristics of the optical system in the optical writing device 8 caused by the heat generated in the fixing device 30.

Furthermore, the transfer belt 20 is configured in such a manner as to be freely turned on at least one of the belt wheels 22 at the traveling side 21 in the preferred embodiment shown in FIG. 1. With this configuration, it is possible to easily cope with jamming which may occur in the transfer belt 20. Here, since the transfer belt 20 is used for monochromatic printing, a belt wheel 22*a* is designed to be descended down to a position indicated by a chain line. The transfer belt 20 when being descended abuts against only the image forming unit 4Bk for the black color while it is separated from the photosensitive drums 5 in the other image forming units 4.

As explained above, according to the image forming apparatus of this invention, the transfer belt device is slantwise disposed in such a manner as to have different height levels at one end and the other end of the traveling side at which the plurality of image forming units are arranged. Therefore, the image forming apparatus can be made compact in both of the vertical and lateral directions.

Furthermore, it is possible to shorten the length of the transporting path for the transfer member to be discharged.

Furthermore, it is possible to reduce the coming-off of the toner from the developing unit and secure the excellent cleaning property.

Furthermore, it is possible to easily cope with the jamming in the transfer belt device.

Furthermore, it is possible to more securely produce the above-described effect of compactness.

Furthermore, it is possible to minimize the dead space inside the apparatus.

Furthermore, it is possible to perform the optical writing with respect to the plurality of image forming units by the single writing unit and easily obtain the same length of the optical path.

Furthermore, it is possible to remarkably reduce the fluctuations in characteristics of the optical system.

Furthermore, it is possible to easily transport the transfer member having passed even if the belt fixing device is used.

Furthermore, it is possible to shorten the path for the double-sided transportation inside of the apparatus.

Furthermore, it is possible to minimize the dead space inside the apparatus.

Furthermore, according to this invention, it is possible to provide a toner replenishing apparatus which can securely produce the effect of minimizing the dead space inside the apparatus.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

The invention claimed is:

1. An image forming apparatus, comprising:

a recording medium supply cassette disposed at a lower part of the image forming apparatus and configured to store a plurality of recording medium sheets;

a first turning unit configured to receive one sheet of the plurality of recording medium sheets stored in the recording medium supply cassette and turn the one sheet upside-down;

a transferring area disposed in a slantwise direction with respect to the ground and configured to receive the one sheet from the first turning unit and transfer an image on the one sheet;

a transfer belt having a surface inclined with respect to the ground in the transferring area;

a plurality of image forming units disposed at intervals along the transfer belt;

a second turning unit configured to receive the one sheet from the transferring area and turning the one sheet right-side up, the second turning unit located at a position higher than the plurality of image forming units with respect to the ground; and an ejection part configured to receive the one sheet from the second turning unit and eject the sheet onto an ejecting position on an upper surface of the image forming apparatus;

a heating and fixing unit disposed downstream of the transfer belt in a recording medium feeding direction, and upstream of the second turning unit in the recording medium feeding direction, wherein the heating and fixing unit includes a fixing roller, a pressurizing roller in press-contact with a lower portion of the fixing roller, a heating roller heated by a heating unit, and a belt wound across the fixing roller and the heating roller, wherein the heating roller is disposed more upstream in the recording medium feeding direction than the fixing roller, wherein the heating roller is positioned under the fixing roller and above the plurality of image forming units, and wherein the recording medium supply cassette, the transferring area, and the ejecting position are overlapped in a vertical direction.

2. The image forming apparatus according to claim 1, wherein the ejecting position is disposed nearly horizontally with respect to the ground.

3. The image forming apparatus according to claim 1, wherein the plurality of image forming units are disposed above the transfer belt.

4. The image forming apparatus according to claim 1, wherein at least one image forming unit further includes a charging roller and a developing device, and is detachably attached to the image forming apparatus.

5. The image forming apparatus according to claim 1, wherein the recording medium supply cassette is below the transferring area and the ejecting position with respect to the ground.

6. The image forming apparatus according to claim 1, wherein the transferring area is above the recording medium supply cassette and below the ejecting position with respect to the ground.

7. The image forming apparatus according to claim 1, wherein the ejecting position is above the transferring area and the recording medium supply cassette with respect to the ground.

8. A method of transferring a sheet through an image forming apparatus:

removing the sheet from a recording medium supply cassette disposed at a lower part of the image forming apparatus;

turning, using a first turning unit, the removed sheet upside-down;

transporting the turned upside-down sheet through a transferring area disposed in a slantwise direction with respect to the ground and transferring an image onto the sheet in the transferring area, the transferring area including a transfer belt having a surface inclined with respect to the ground and a plurality of image forming units disposed at intervals along the transfer belt;

transporting the sheet through a heating and fixing unit downstream of the transfer belt in a recording medium feeding direction, and upstream of a second turning unit in the recording medium feeding direction, the heating and fixing unit including a fixing roller, a pressurizing roller in press-contact with a lower portion of the fixing roller, a heating roller heated by a heating unit, and a belt wound across the fixing roller and the heating roller, the heating roller being disposed more upstream in the recording medium feeding direction than the fixing roller and the heating roller being positioned under the fixing roller and above the plurality of image forming units;

turning, using the second turning unit, the sheet transported through the transferring area and the heating and fixing unit right-side up, the second turning unit located at a position higher than the plurality of image forming unit with respect to the ground; and ejecting the turned right-side up sheet onto an ejecting position on an upper surface of the image forming apparatus, the ejecting position, the transferring area, and the recording medium supply cassette being overlapped in a vertical direction.

9. A computer-readable program storage medium including program instructions that cause a device processor to implement a method of transferring a sheet through an image forming apparatus, the method comprising:

removing the sheet from a recording medium supply cassette disposed at a lower part of the image forming apparatus;

turning, using a first turning unit, the removed sheet upside-down;

transporting the turned upside-down sheet through a transferring area disposed in a slantwise direction with respect to the ground and transferring an image onto the sheet in the transferring area, the transferring area including a transfer belt having a surface inclined with respect to the ground and a plurality of image forming units disposed at intervals along the transfer belt;

transporting the sheet through a heating and fixing unit downstream of the transfer belt in a recording medium feeding direction, and upstream of a second turning unit in the recording medium feeding direction, the heating and fixing unit including a fixing roller, a pressurizing roller in press-contact with a lower portion of the fixing roller, a heating roller heated by a heating unit, and a belt wound across the fixing roller and the heating roller, the heating roller being disposed more upstream in the recording medium feeding direction than the fixing roller and the heating roller being positioned under the fixing roller and above the plurality of image forming units;

turning, using the second turning unit, the one sheet transported through the transferring area and the heating and fixing unit right-side up, the second turning unit located at a position higher than the plurality of image forming unit with respect to the ground; and ejecting the turned right-side up sheet onto an ejecting position on an upper surface of the image forming apparatus, the ejecting position, the transferring area, and the recording medium supply cassette being overlapped in a vertical direction.

* * * * *